US005561441A

United States Patent [19]

Hamano

[11] Patent Number: 5,561,441

[45] Date of Patent: Oct. 1, 1996

[54] LIQUID CRYSTAL DISPLAY DEVICE

[75] Inventor: Yasukazu Hamano, Tokorozawa, Japan

[73] Assignee: Citizen Watch Co., LTD., Tokyo, Japan

[21] Appl. No.: 356,792

[22] Filed: Dec. 13, 1994

Related U.S. Application Data

[63] Continuation of Ser. No. 44,196, Apr. 8, 1993, abandoned.

[51] Int. Cl.[6] ..... G09G 3/36

[52] U.S. Cl. ..... 345/91; 345/96

[58] Field of Search ..... 345/94, 96, 89, 345/98, 90, 91, 87, 209; 359/58, 60

[56] References Cited

U.S. PATENT DOCUMENTS

| | | | |
|---|---|---|---|
| 4,743,096 | 5/1988 | Wakai et al. | 345/89 |
| 4,872,059 | 10/1989 | Shinabe | 345/89 |
| 4,945,352 | 7/1990 | Ejiri | 345/96 |
| 5,014,048 | 5/1991 | Knapp | 345/91 |
| 5,117,298 | 5/1992 | Hirai | 345/96 |
| 5,119,085 | 6/1992 | Yamazaki | 345/89 |

FOREIGN PATENT DOCUMENTS

| | | |
|---|---|---|
| 0360523A3 | 3/1990 | European Pat. Off. . |
| 0376233A3 | 7/1990 | European Pat. Off. . |
| 0508628A3 | 10/1992 | European Pat. Off. . |
| 181229 | 5/1989 | Japan . |

OTHER PUBLICATIONS

'Patent Abstracts of Japan, vol. 15, No. 192 (P–1202) May 17, 1991.

*Primary Examiner*—Steven J. Saras

*Attorney, Agent, or Firm*—Finnegan, Henderson, Farabow, Garrett and Dunner

[57] ABSTRACT

A liquid crystal display panel of the active matrix type which uses, as switching elements, non-linear resistance elements that exhibit asymmetric non-linear characteristics depending upon the polarity of the applied voltage, without causing flickering or scorching of the display. The amplitude of the data signal is changed depending on the characteristics of the non-linear resistance element, such as a2 in the positive-side field and b2 in the negative-side field, and the panel is driven in a manner that the transmission factor modulation range is the same in the positive-side field and in the negative-side field. In the gradation display based on the pulse width modulation, the pulse width is adjusted depending on the non-linear characteristics in the positive-side field and in the negative-side field, such that the relationship between the degree of gradation and the transmission factor is the same on the positive side and on the negative side.

6 Claims, 14 Drawing Sheets

$T_o = f_b + e_b$
$= f_c + e_c$

LIQUID CRYSTAL DISPLAY DEVICE

This application is a continuation of application Ser. No. 08/044,196, filed Apr. 8, 1993, now abandoned.

BACKGROUND OF THE INVENTION

1. Field of the Invention

The present invention relates to a method of driving a liquid crystal display panel of the active matrix type which uses non-linear resistance elements as switching elements. In particular, the invention relates to a method of driving a liquid crystal display panel having non-linear resistance elements that exhibit asymmetric non-linear characteristics depending upon the polarity of a voltage applied to the elements.

2. Description of the Related Art

The liquid crystal display panels are becoming large, and the liquid crystal display panels of a simple matrix constitution which employ multiplex drive systems have a problem of a decrease in contrast with an increase in the rate of time division, making it difficult to obtain a sufficient degree of contrast in the case when they have 200 or more scanning lines. In order to eliminate the above defect, therefore, there has been employed a liquid crystal display panel of the active matrix type in which the individual liquid crystal pixels are provided with a switching element. The liquid crystal display panels of the active matrix type can roughly be divided into those of the three-terminal type which use thin-film transistors and those of the two-terminal type which use non-linear resistance elements. From the standpoint of construction and fabrication, however, the panels of the two-terminal type are superior. The panels of the two-terminal type include those of the diode type, varistor type, MIM (metal-insulator-metal) type and the like types. Among them, however, the panel of the MIM type is particularly simple in construction and can be fabricated using a reduced number of steps.

FIG. 10 shows a constitution of a liquid crystal display panel which employs non-linear resistance elements. Scanning electrodes S1 to SN and signal electrodes D1 to DN are provided on the opposing surfaces of two pieces of glass substrate. A display pixel consisting of a non-linear resistance element 41 and a liquid crystal pixel 42 is formed at each intersecting portion of the scanning electrode and the signal electrode. When a drive voltage is applied to turn the liquid crystal pixel 42 on, the non-linear resistance element exhibits a small resistance and the liquid crystal pixel is turned on with a small time constant. When the drive voltage is turned off, the non-linear resistance element exhibits a large resistance and the electric discharge takes place with a large time constant. The result therefore is an increase in the ratio of effective values of voltages applied to the liquid crystals when they are to be turned on and off, making it possible to carry out the multiplex driving while maintaining a high pixel density.

Some non-linear resistance elements exhibit asymmetric non-linear characteristics depending upon the polarity of the applied voltage. That is, referring to FIG. 2 which shows the transmission factor with respect to the write voltage, the positive-side characteristics and the negative-side characteristics are asymmetrical to each other and electrical-optic due to the asymmetric characteristics of the non-linear resistance element. Here, the positive side stands for the case where a positive voltage is applied to the non-linear resistance element when the display pixel is regarded to be an equivalent circuit in which the non-linear resistance element and the liquid crystal pixel are connected in series, and the negative side stands for the case where a negative voltage is applied thereto. FIG. 11 shows voltage-current characteristics wherein large asymmetric characteristics are exhibited with respect to the polarity of the applied voltage. The curve A represents element characteristics of the positive side and the curve B represents element characteristics of the negative side. When the liquid crystal display panel is to be multiplex-driven, in general, the voltage applied to the liquid crystal pixel is inverted for every field (period from a given scan to a next scan of the same line) or is inverted for every line by the AC driving method. Here, however, if attention is given to the voltage applied to the liquid crystal pixel under the condition where the non-linear resistance element exhibits asymmetric non-linear characteristics depending on the positive side and the negative side as described above, different voltages are eventually applied to the liquid crystal pixel since different voltages are applied to the non-linear resistance element depending on the positive side and the negative side.

As a result, flickering and deviation of ions in the liquid crystal causes the image to be printed on the pixel such as a residual image phenomenon and the display quality deteriorates greatly.

Also, Japanese Patent Application No. 181229/1989 discloses a method of enhancing the quality of display by compensating asymmetric non-linear characteristics. The driving method disclosed in application No. 181229/1989 will now be described with reference to FIGS. 12 and 11. As shown in FIG. 12, the feature of this driving method resides in that different offset voltages, i.e., Voff 3 and Voff 2 are applied to the scanning electrode depending upon writing and non-writing. Here, the offset voltages are set as described below. First, an element turn-on current during writing determined from the drive voltage and an element turn-off current during the non-writing are drawn on the diagram of voltage-current characteristics of a non-linear resistance element of FIG. 11. A voltage is found that corresponds to an intermediate point P1 of the voltage corresponding to the turn-on current between the positive side and the negative side, and is denoted as Voff 3. Similarly, a voltage is found that corresponds to an intermediate point P2 of the voltage corresponding to the turn-off current between the positive side and the negative side, and is denoted as Voff 2. Thus, the offset voltage is not simply applied but the offset voltages are independently set depending on the writing and the non-writing voltages, in order to realize the drive voltage that correctly corresponds to the voltage-current characteristics of the positive side and negative side of the non-linear resistance element.

The above-mentioned method of adjusting the offset voltage of the scanning signal is capable of preventing the quality of the display from deteriorating due to the asymmetric characteristics of the non-linear resistance element, but is not sufficient since the amplitude of the data signal remains constant and the transmission factor modulation range of the liquid crystal pixel for the write voltage is different depending on the positive side and the negative side.

There also exists a problem in the gradation display. FIG. 13 shows waveforms of data signals in the case when the gradation is displayed using pulse width modulation. The ratio of a period f in which the voltage is Vd1 to a period e in which the voltage is Vd2 is changed depending upon the gradation. Reference is made to FIG. 13 where a pixel is driven by a pulse having the same ratio of positive-side field to negative-side field. When the non-linear characteristics of the non-linear resistance element are greatly asymmetrical due to the polarity of the voltage, the transmission factors due to the positive-side field and the negative-side field become equal at a point g only as shown in FIG. 14 but are different in other transmission factor regions. Even in this case, therefore, it is not possible to sufficiently prevent the degradation of image quality caused by flickering and scorching. The object of the present invention is to provide a method of driving a liquid crystal display panel based on a pulse-width-modulation writing system of a high display quality which is free from problems caused by the pulse waveforms applied to the signal electrodes.

SUMMARY OF THE INVENTION

In order to achieve the above-mentioned object, the present invention deals with a method of driving a liquid crystal display panel to write gradation display data by applying scanning signals and data signals of which the pulse varies depending upon the gradation to a liquid crystal display panel of the active matrix type which uses, as switching elements for driving liquid crystal pixels, non-linear resistance elements that exhibit asymmetric non-linear characteristics depending upon the polarity of the applied voltage, characterized by that the amplitude of said data signal is individually set depending upon the characteristics of the non-linear resistance elements when the gradation display data is written by applying a positive voltage to said liquid crystal pixels and when the gradation display data is written by applying a negative voltage thereto at the boundaries in a working transmission range of the liquid crystal to provide the same transmission factors.

The present invention further deals with a method, characterized by that the pulse width of said data signals is individually set depending upon the characteristics of the non-linear resistance elements when the gradation display data is written by applying a positive voltage to said liquid crystal pixels and when the gradation display data is written by applying a negative voltage thereto, corresponding to the change of the gradation.

The present invention also deals with a method, characterized by that the pulse widths of the said signal are set to be equal to each other in the positive-side field and the negative-side field and the pulse amplitudes of the said signal are individually set depending upon the characteristics of the non-linear resistance elements when the gradation display data is written by applying a positive voltage to said liquid crystal pixels and when the gradation display data is written by applying a negative voltage thereto, corresponding to said change of the gradation.

The present invention further deals with a method, characterized by that the pulse amplitudes of the said data signals are set to be equal to each other in the positive-side field and the negative-side field and the pulse widths of the said data signals are individually set depending upon the characteristics of the non-linear resistance elements when the gradation display data is written by applying a positive voltage to said liquid crystal pixels and when the gradation display data is written by applying a negative voltage thereto, corresponding to said change of the gradation.

The present invention further deals with a method, characterized by that the pulse amplitude of said signals is individually set depending upon the characteristics of the non-linear resistance elements when the gradation display data is written by applying a positive voltage to said liquid crystal pixels and when the gradation display data is written by applying a negative voltage thereto so that said data signals are formed in three levels to drive said liquid crystal display panel.

DESCRIPTION OF THE PREFERRED EMBODIMENTS

Figure 10:
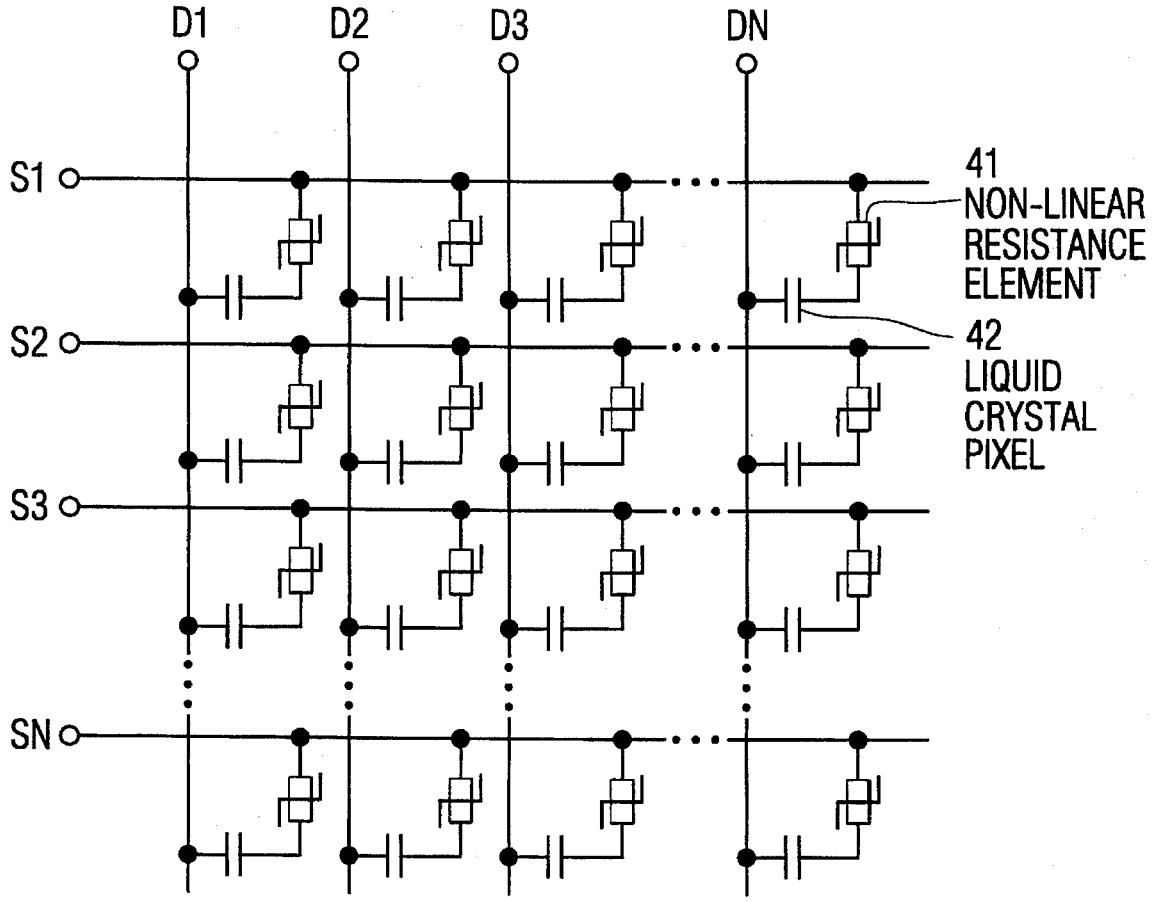
FIG. 10 PRIOR ART
FIG. 10 is a diagram illustrating the constitution of a liquid crystal panel equipped with non-linear resistance elements in a conventional driving method.
Figure 11:
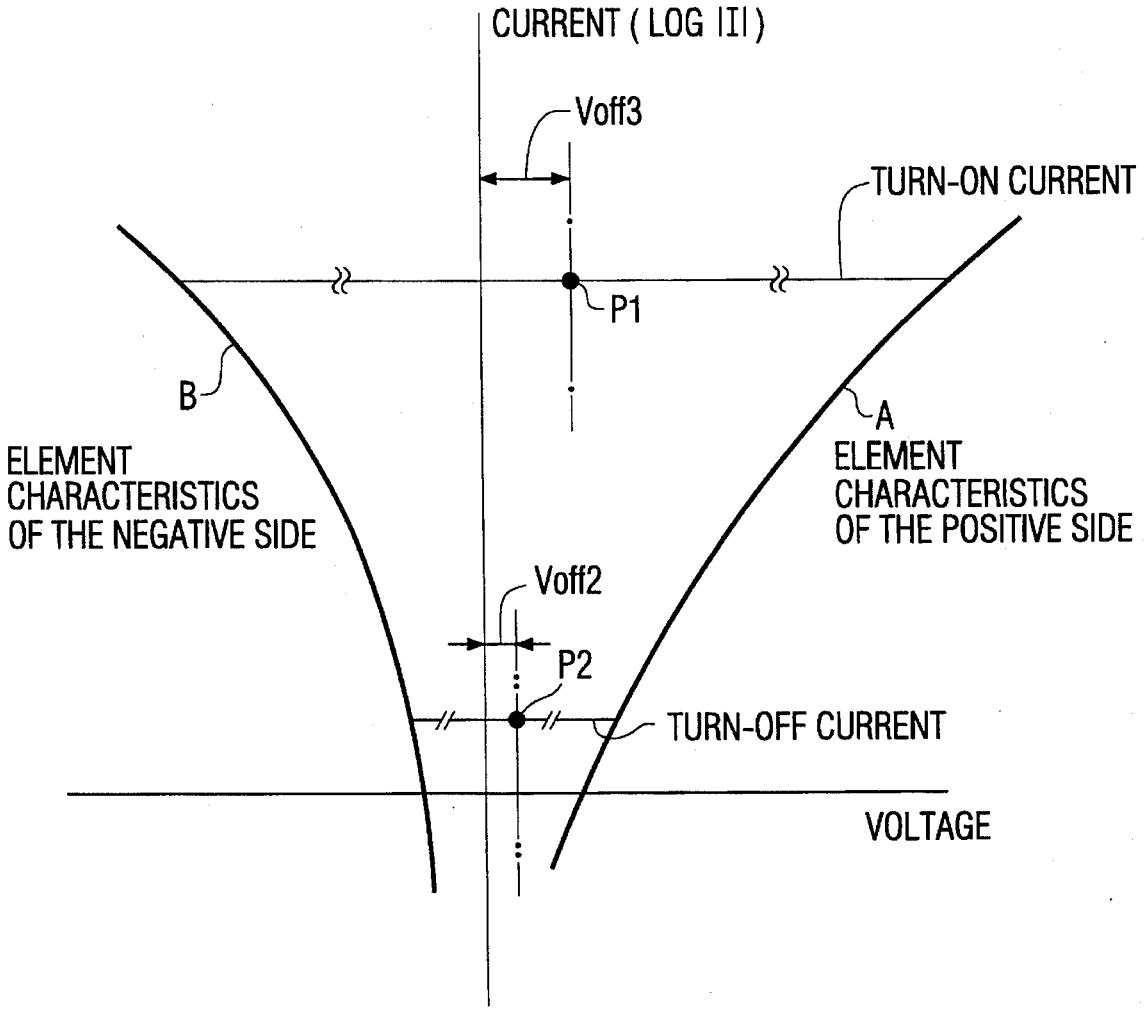
FIG. 11 PRIOR ART
FIG. 11 shows voltage-current characteristics of a non-linear resistance element having asymmetric non-linear characteristics in a conventional driving method.
Figure 12:
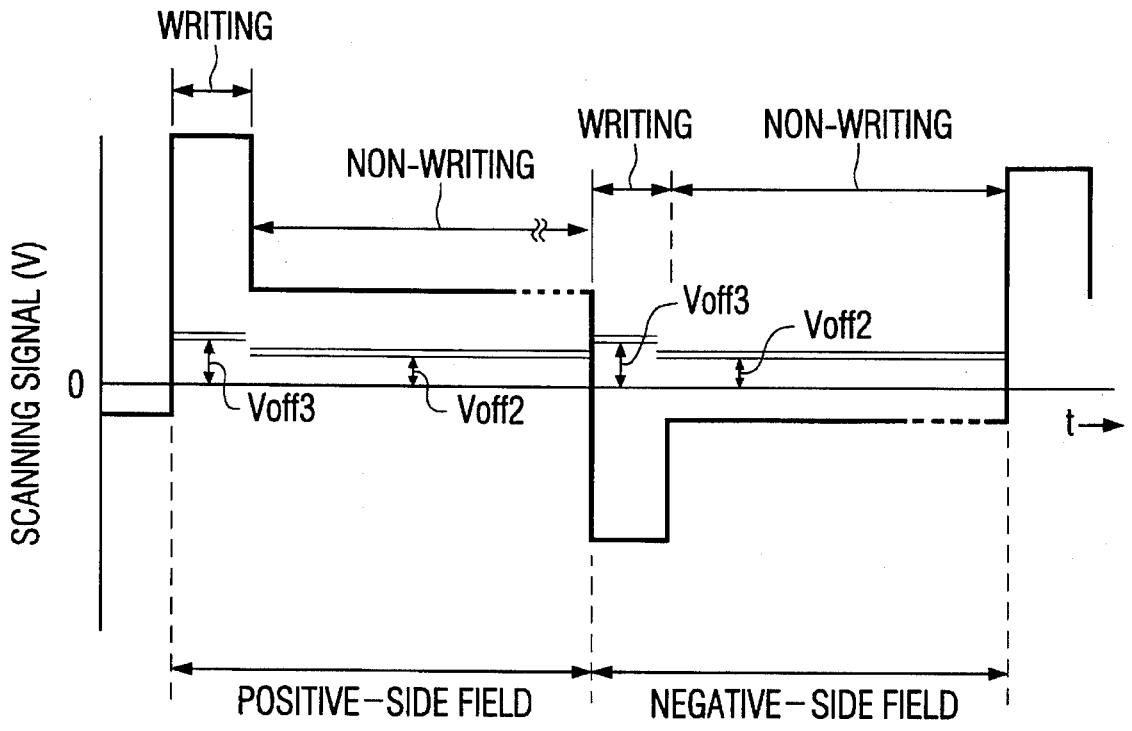
FIG. 12 PRIOR ART
FIG. 12 is a diagram of waveforms of scanning signals in a conventional driving method.
Figure 13:
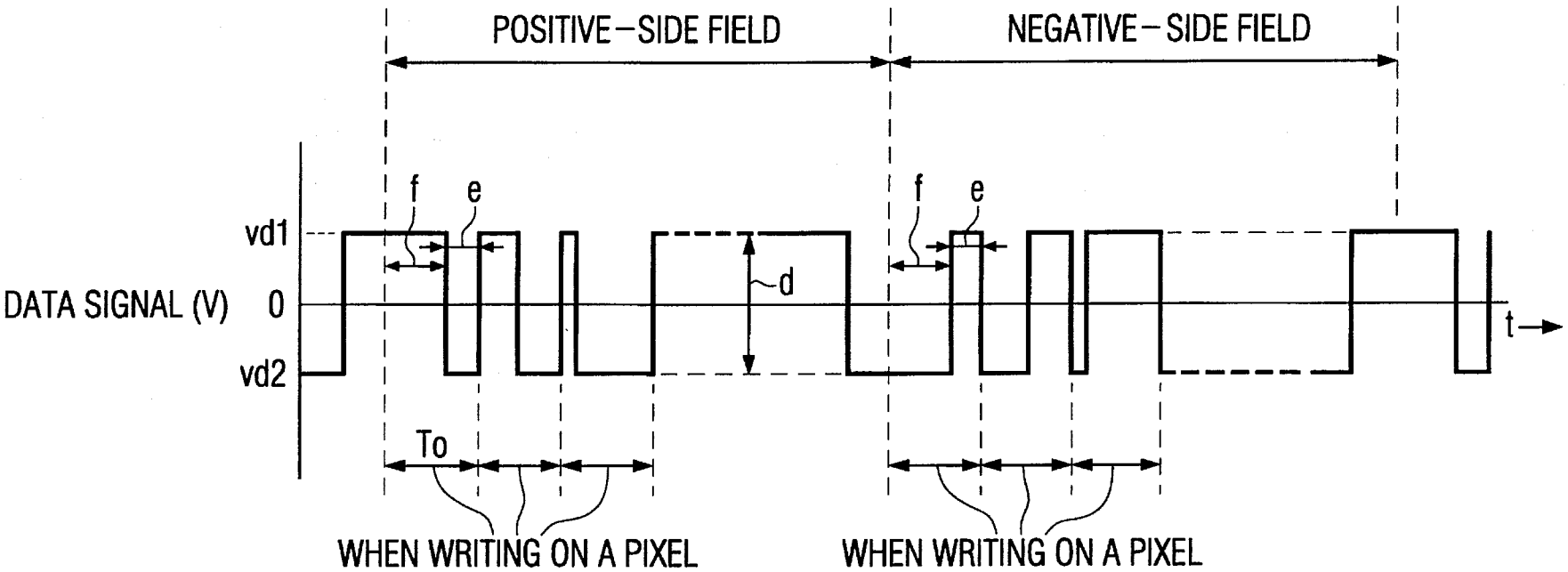
FIG. 13 PRIOR ART
FIG. 13 is a diagram of waveform of data signals in the conventional driving method.

An embodiment of the present invention will now be described in conjunction with the drawings. The liquid crystal display panel used in this embodiment has the constitution of FIG. 10 that is used by the conventional driving method. Moreover, the non-linear resistance element exhibits the same characteristics as those employed by the conventional driving method, and its voltage-current characteristics are as shown in FIG. 11. The liquid crystal display panel is driven by an application voltage, that is, by applying a scanning voltage shown in FIG. 1 to the scanning electrode and by applying a data signal voltage of FIG. 1 and the like to the signal electrode. The waveforms of these signals will now be described in detail. The voltages c and d of scanning signals during the non-writing period are those obtained by adding the offset voltage Voff2 of FIG. 12 to the bias voltages Vbias 1 and Vbias 2. It has been known that the drivability increases when the bias voltage is applied, and the asymmetric characteristics of the element during the non-writing are relatively compensated when the offset voltage is applied.

Figure 1:
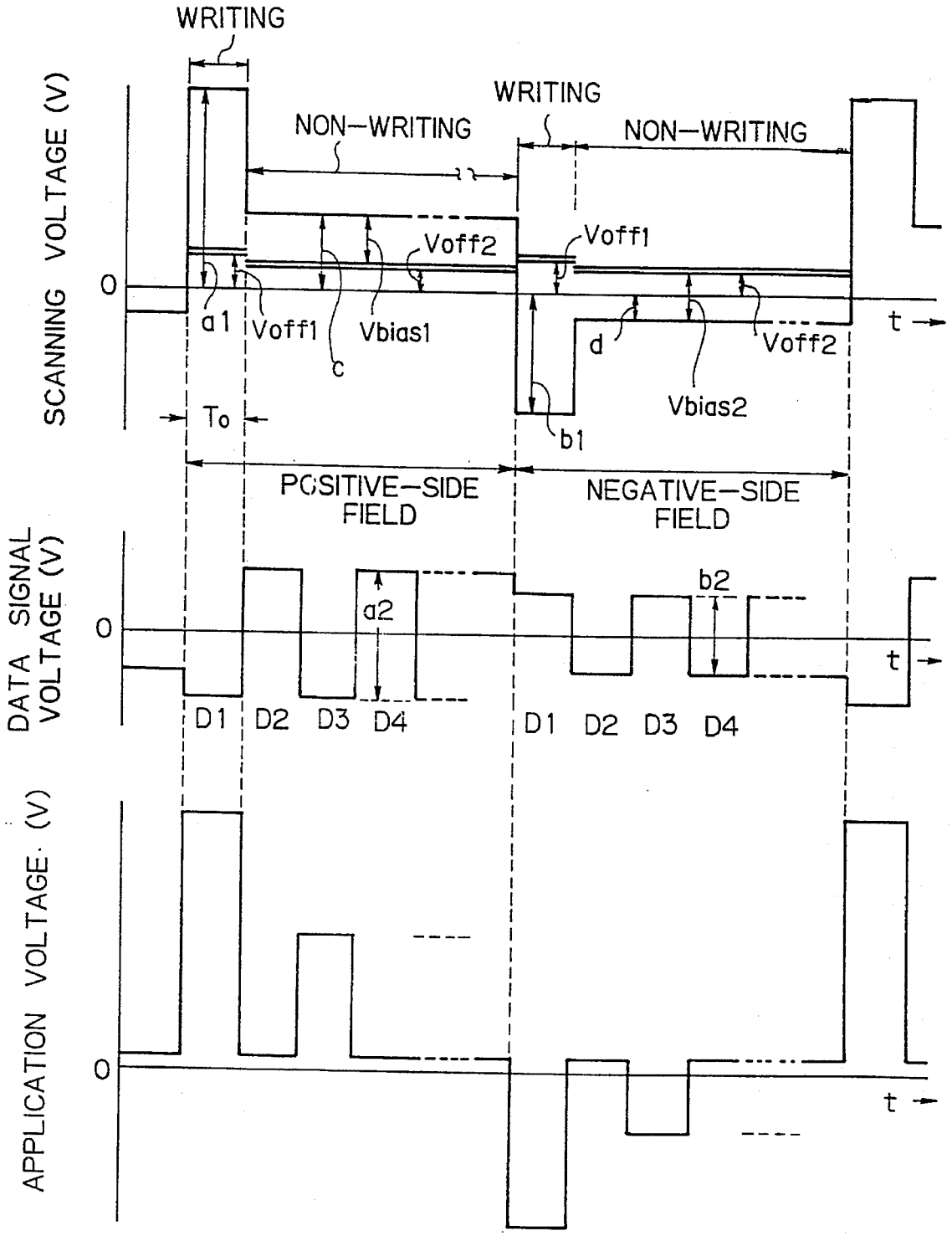
FIG. 1 is a diagram of signal waveforms illustrating the driving method according to a first embodiment of the invention.
Figure 2:
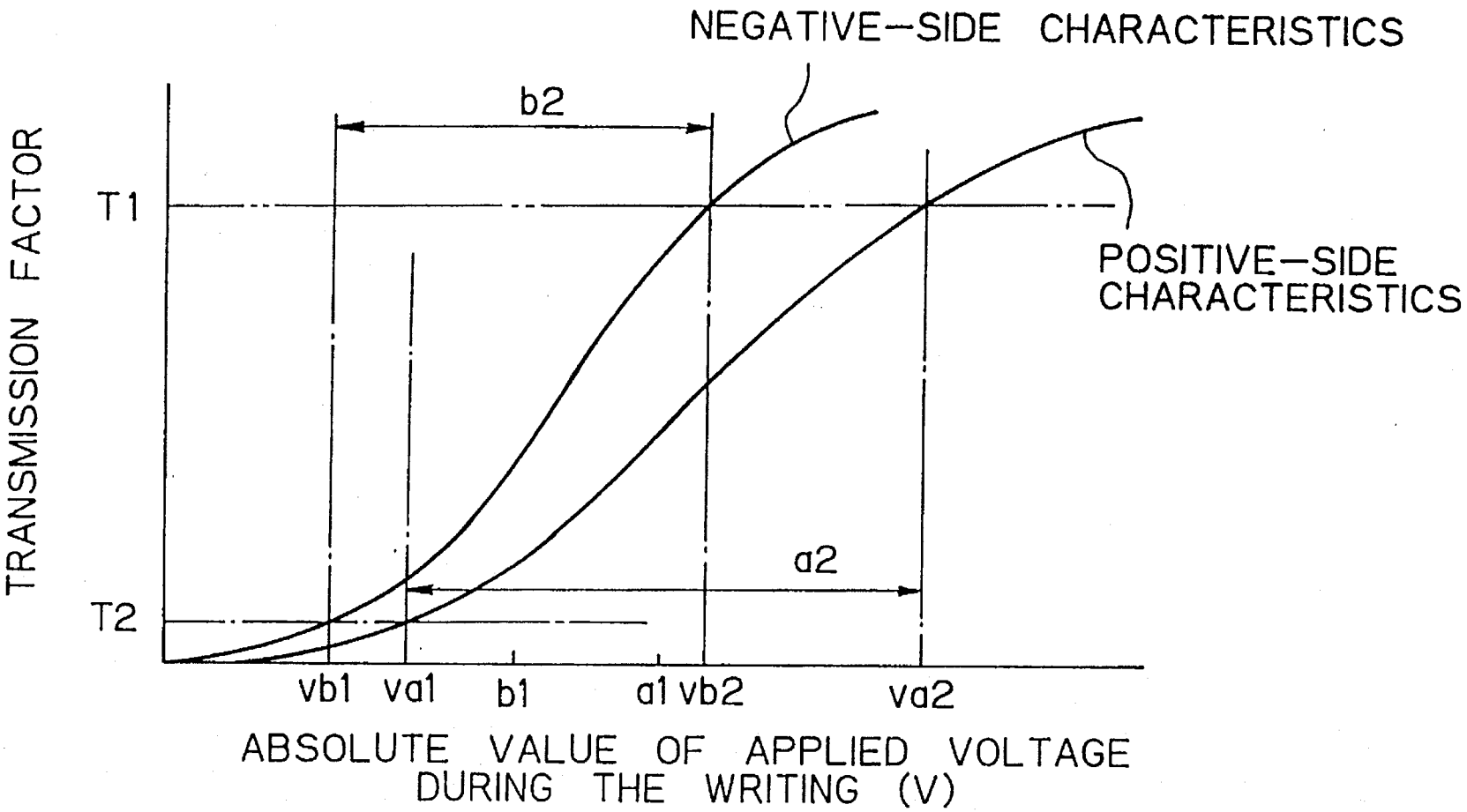
FIG. 2 is a diagram illustrating a relationship between the write voltage and the transmission factor.

The scanning voltage of the scanning signal is set as described below. FIG. 2 is a diagram showing application voltage characteristics for the transmission factor during the writing when the data signal voltage is set to 0 V and the application voltages during the writing onto the pixel in the two fields are so found that the transmission factor is the same between the positive-side field and the negative-side field during the writing. Here, if the modulation range of the transmission factor is set to be from T1 to T2, then the corresponding application modulation voltage during writing is a2 in the positive-side field and is b2 in the negative-side field. In the present invention in which the transmission factor is modulated by the method of modulating the pulse amplitude from the signal electrode as shown in FIG. 1, the application voltage from the scanning electrode during the writing is set to be a center point of voltages that correspond to the transmission factors T1 and T2. That is, (Va1+Va2)/2=a1 in the positive-side field and (Vb1+Vb2)/2=b1 in the negative-side field. Therefore, the offset voltage during writing is the difference between a1 and b1, which is Voff 1. This offset voltage can be optimized for the pulse amplitude modulation and creates a special case of offset voltage from the standpoint of prior art.

The maximum amplitude of the data signal is set to be the voltage that corresponds to the modulation range T1 to T2 of transmission factor of FIG. 2 and the amplitude thereof is controlled corresponding to the gradation. That is, the voltage a2 is applied in the positive-side field and the voltage b2 is applied in the negative-side field.

In this way, the difference of the transmission between the positive-side field and the negative-side field is decreased regarding the pulse amplitude modulation.

Figure 3:
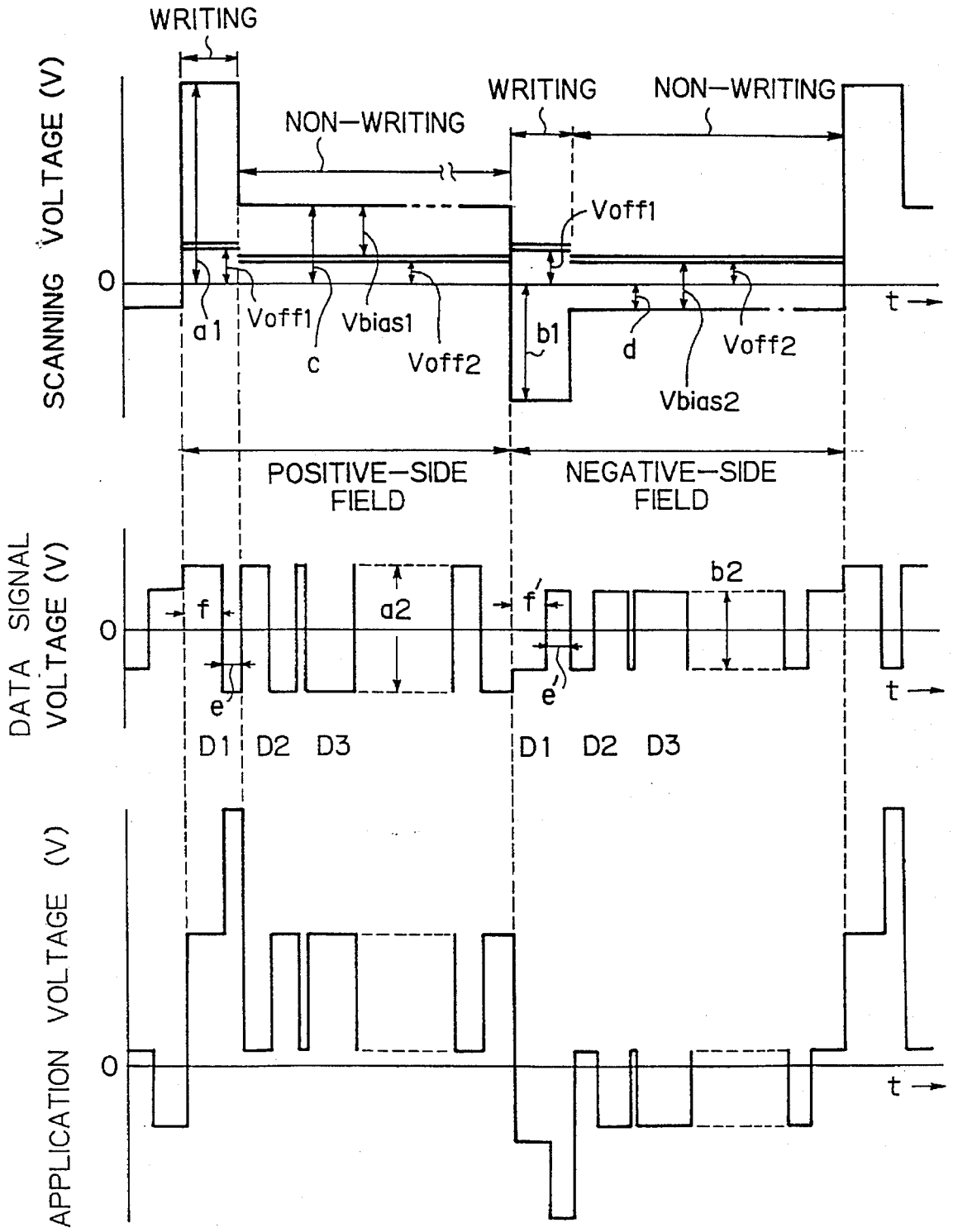
FIG. 3 is a diagram of signal waveforms illustrating the driving method according to a second embodiment of the invention.
Figure 4:
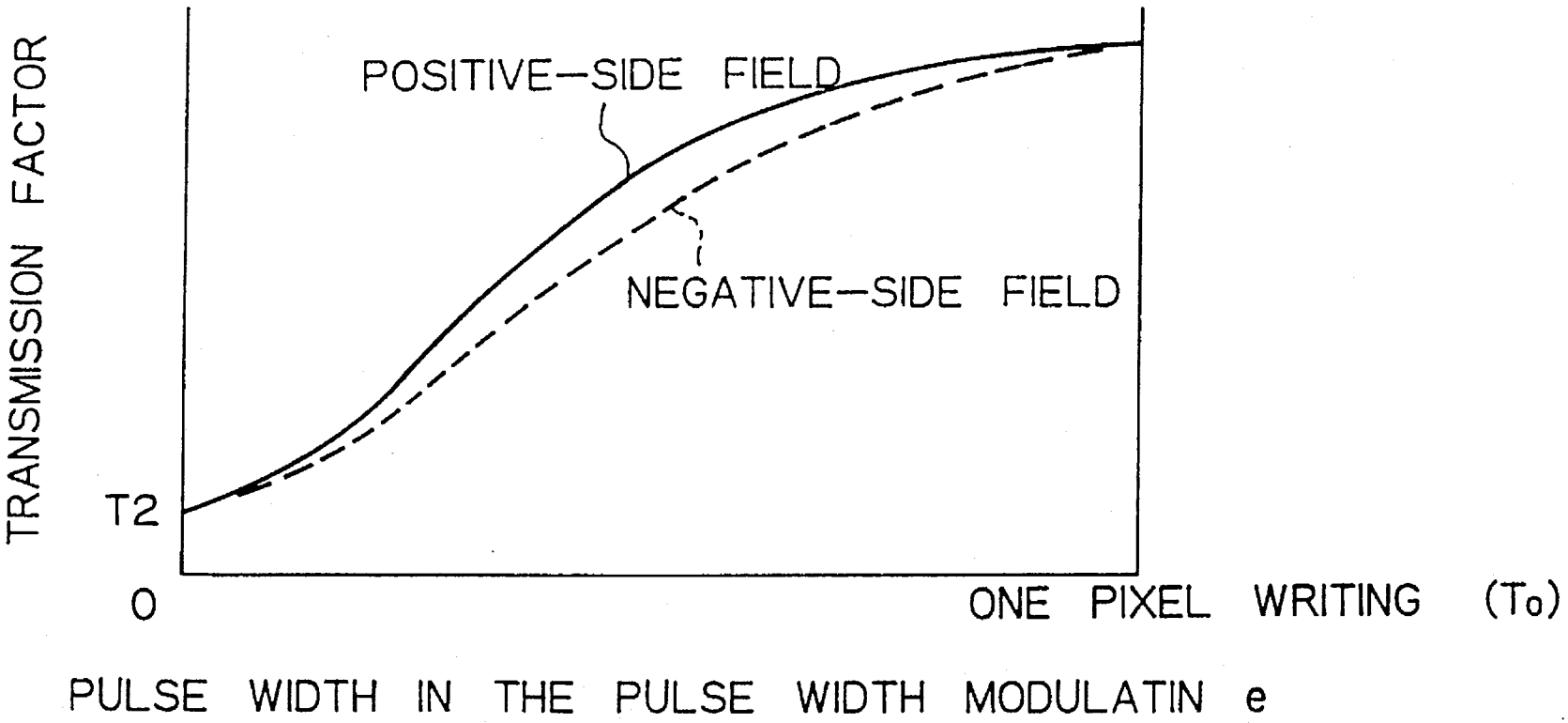
FIG. 4 is a diagram illustrating transmission characteristics after setting the waveform in FIG. 1.
Figure 5:
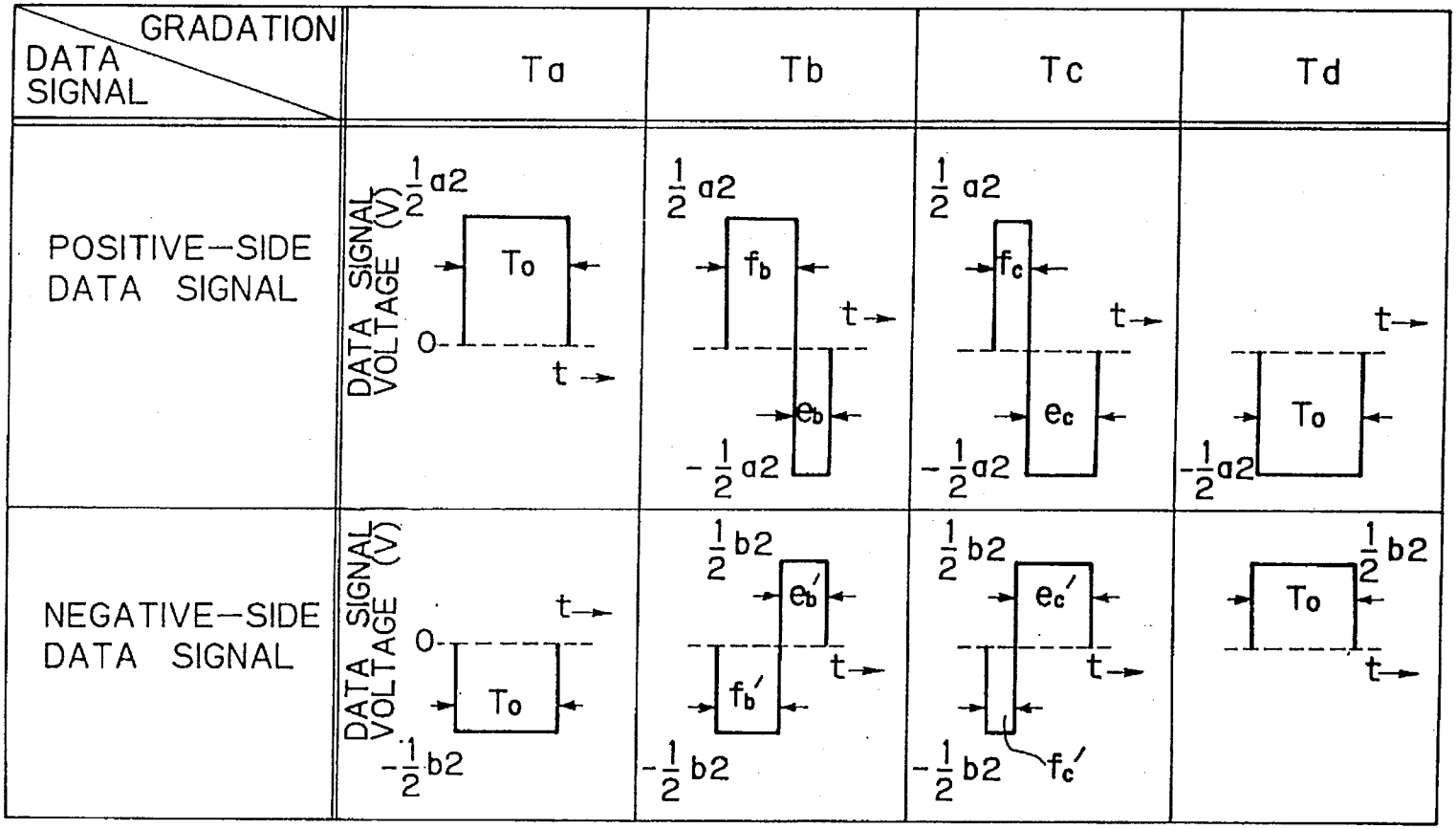
FIG. 5 is a diagram waveforms of data signals according to the second embodiment.

Next, as shown in FIG. 3, the transmission factor is modulated by the method of modulating the width of the pulse from the signal electrode. As explained above, in this case of setting the voltages of the scanning signals in the positive-side field and the negative-side field to be a1, b1, setting the voltages of the data signals in the positive-side field and the negative-side field to be a2, b2, and using the pulse width modulation in which the pulse widths are equal to each other for each of gradations in the positive-side field and the negative-side field, the difference of the transmission is as shown in FIG. 4 during the intermediate gradation. Hereafter reduction of the difference of the transmission will be discussed. FIG. 5 shows data signals in each of the gradations of which the gradation display is effected in four gradations. Ta and Td correspond to T2 and T1 of FIG. 2, and Tb and Tc are intermediate transmission factors. Thus, there are used data signals having pulse widths which are separately adjusted in the positive-side and in the negative-side field such that the transmission factors will become equal to each other in the positive-side field and in the negative-side field in each of the gradations as shown in FIG. 3.

Figure 6:
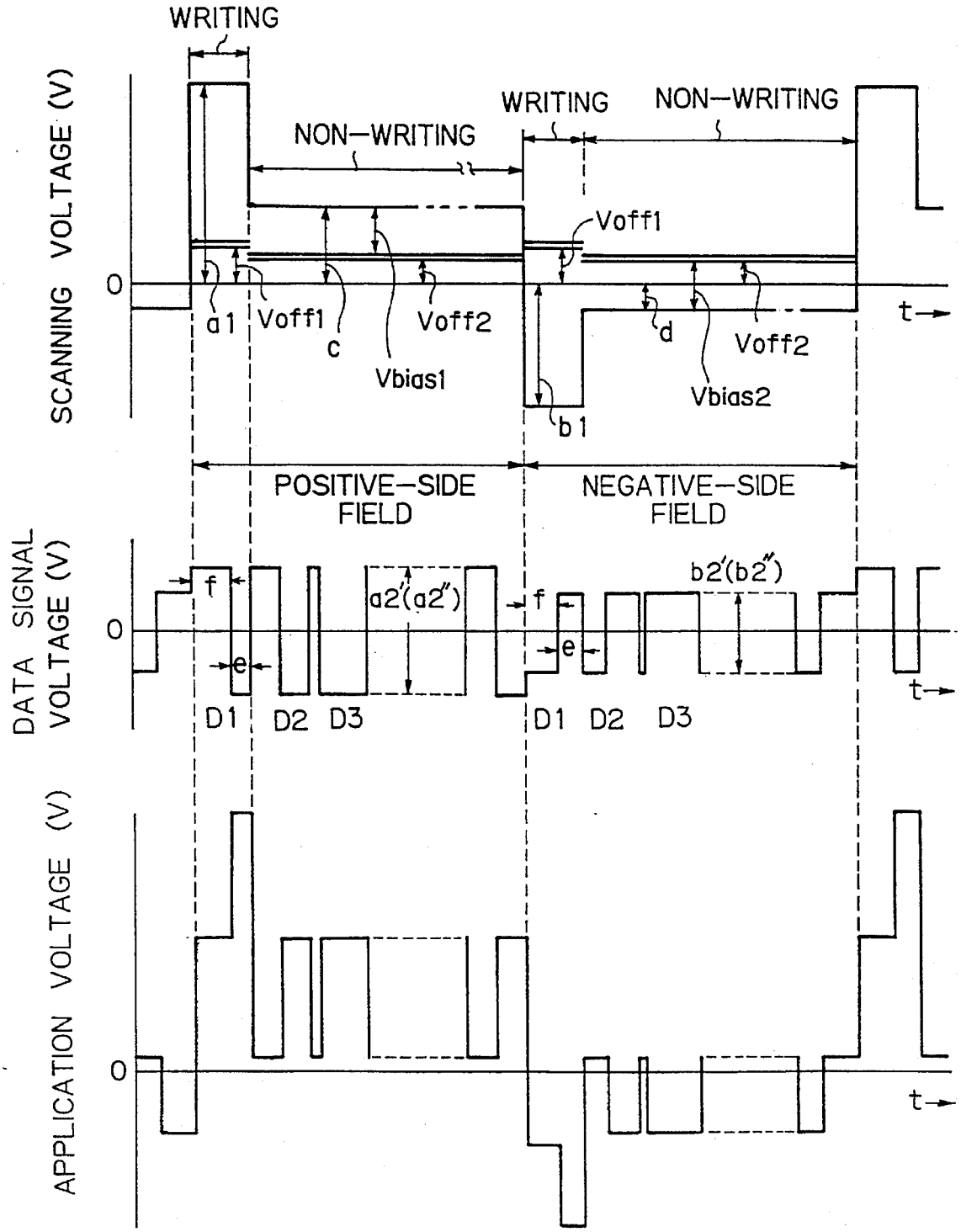
FIG. 6 is a diagram of signal waveforms illustrating the driving method according to a third embodiment of the invention.
Figure 7:
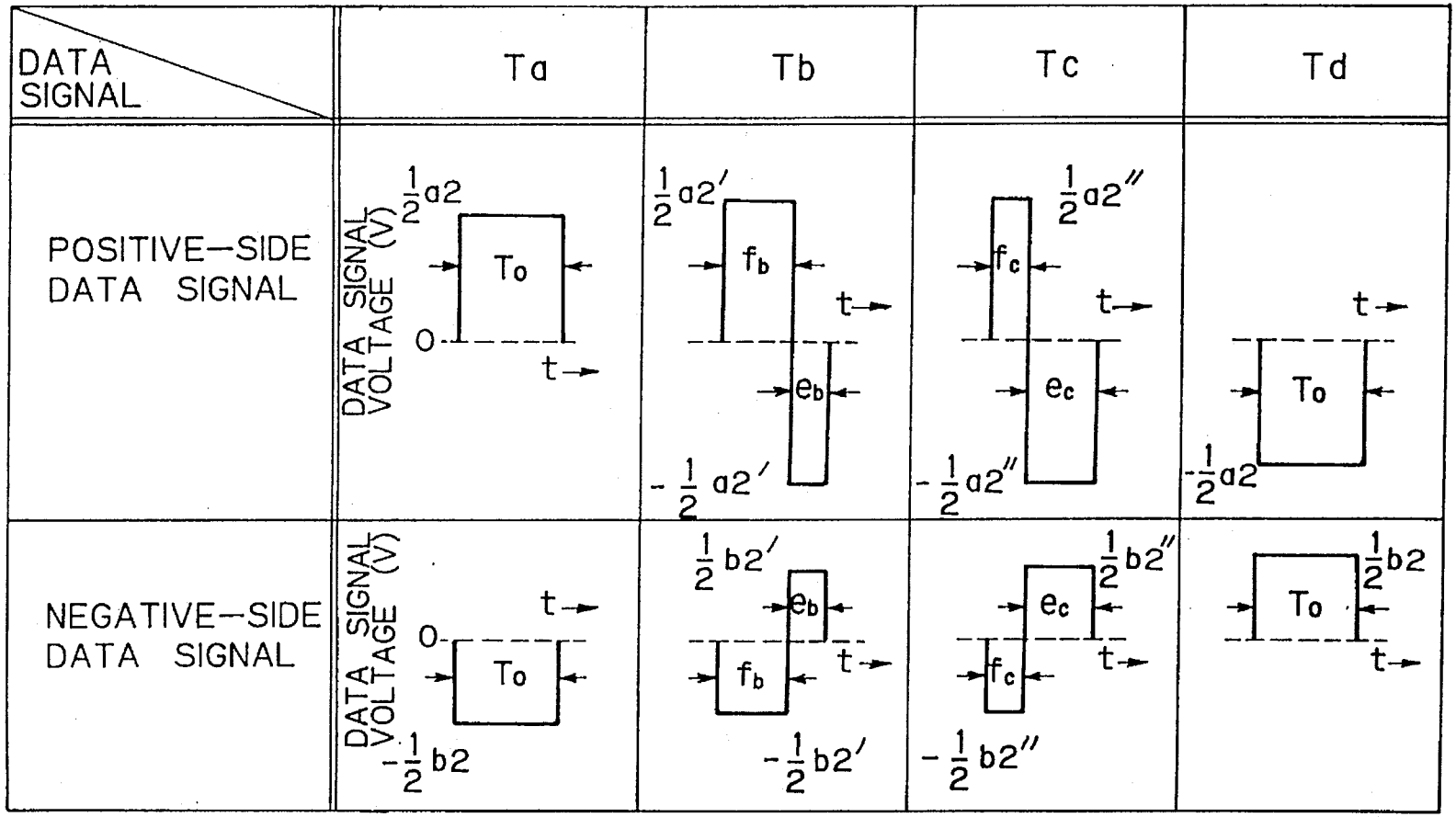
FIG. 7 is a diagram of waveform of data signals of FIG. 6.

For a modification as shown FIG. 6, the pulse amplitudes of data signals corresponding to T2 and T1 are the same as that of FIG. 2. Next, the ratio of the widths f and e of the data signals is set to be constant in the positive-side field and the negative-side field in the pulse width modulation method for the gradation display. As a result a problem as shown in FIG. 4 arises in the intermediate gradation when a liquid crystal display panel is driven. Therefore, for the above problem, as shown in FIG. 7, the pulse amplitudes a2'(a2"), b2'(b2") of the data signals in the intermediate gradation is corrected to be a2'(a2"), b2'(b2") in the positive-side field and the negative-side field respectively, so that the transmission factor becomes constant for each of the gradations.

Figure 8:
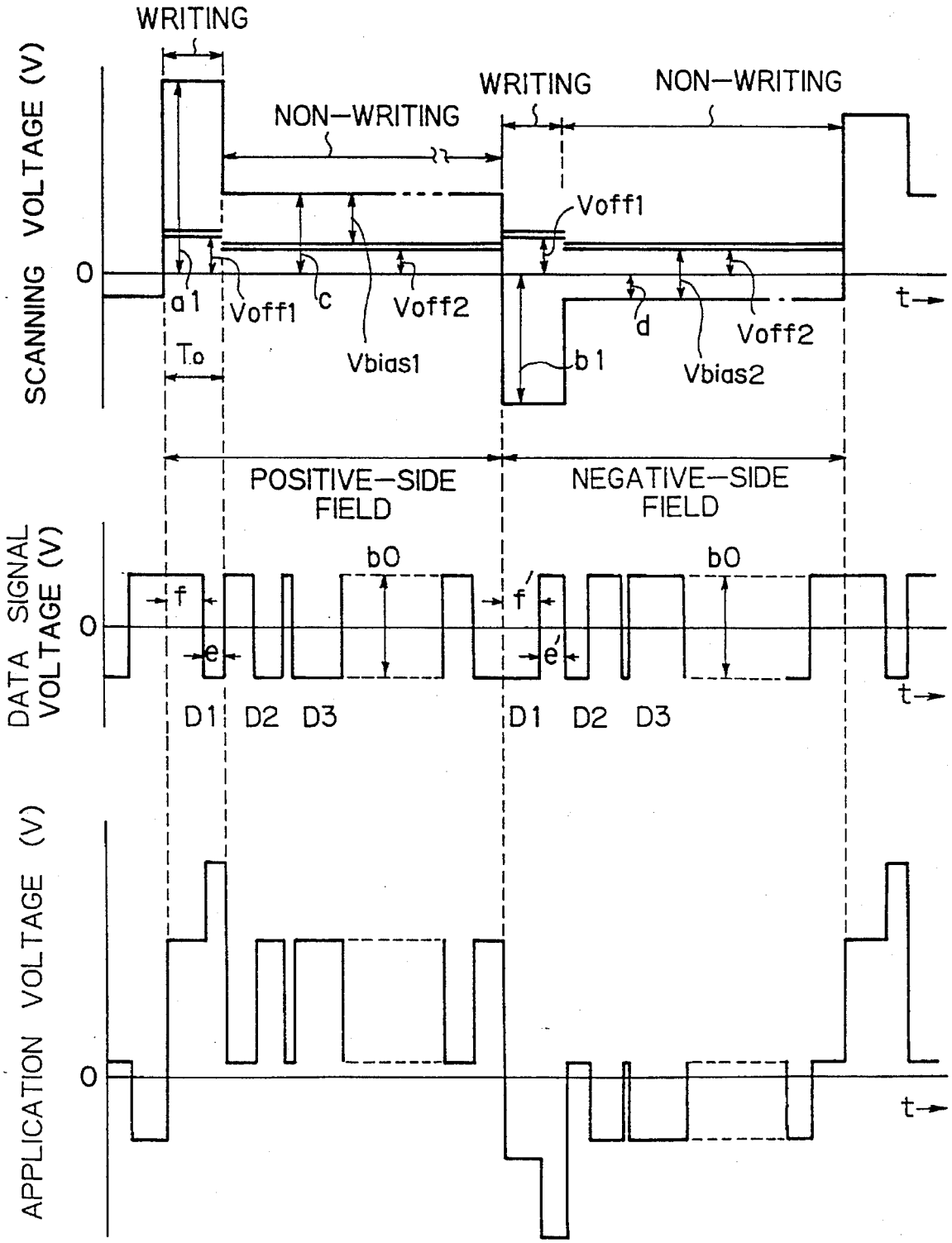
FIG. 8 is a diagram of signal waveforms illustrating the driving method according to a fourth embodiment of the invention.
Figure 9:
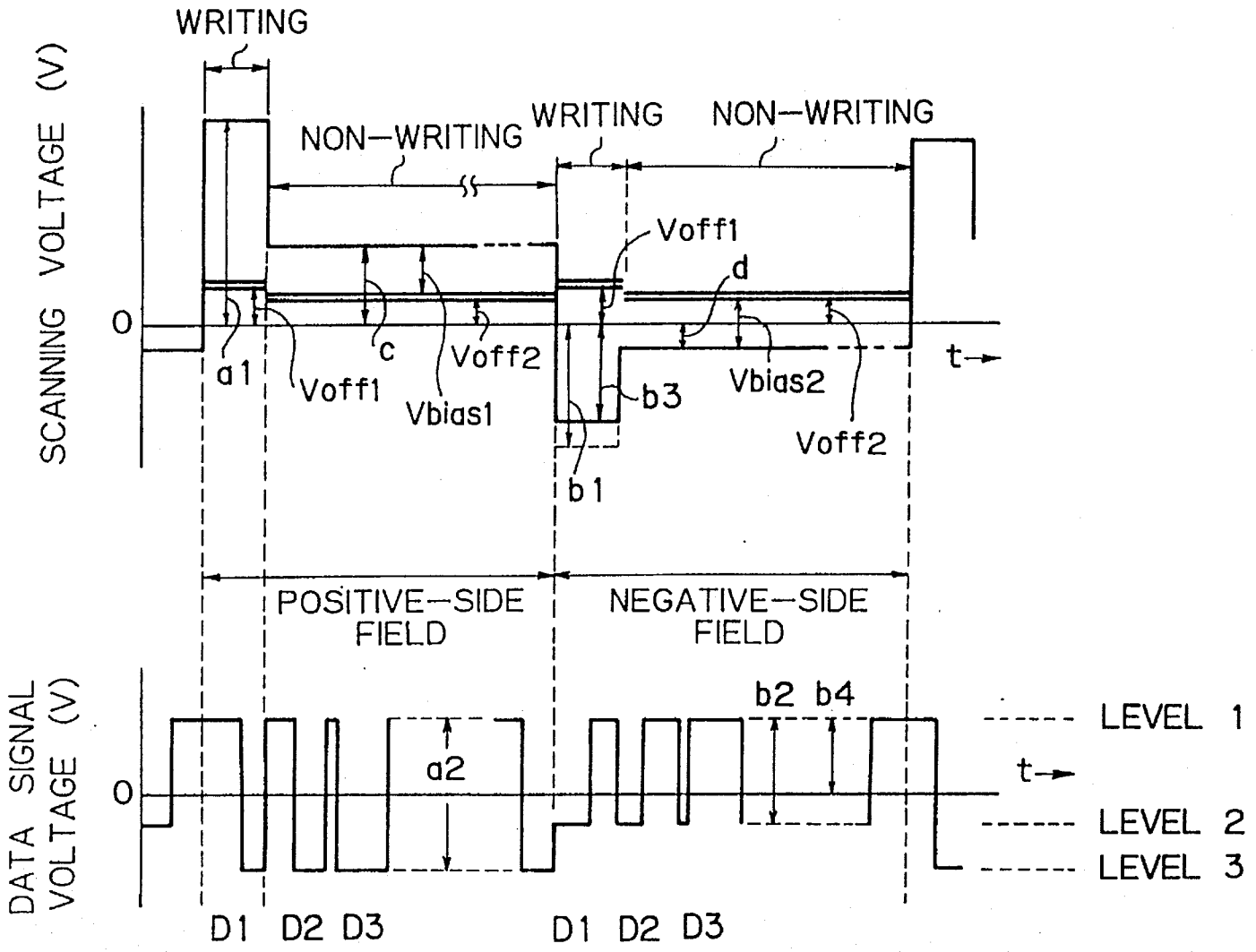
FIG. 9 is a diagram of signal waveforms illustrating the driving method according to a fifth embodiment of the invention.
Figure 14:
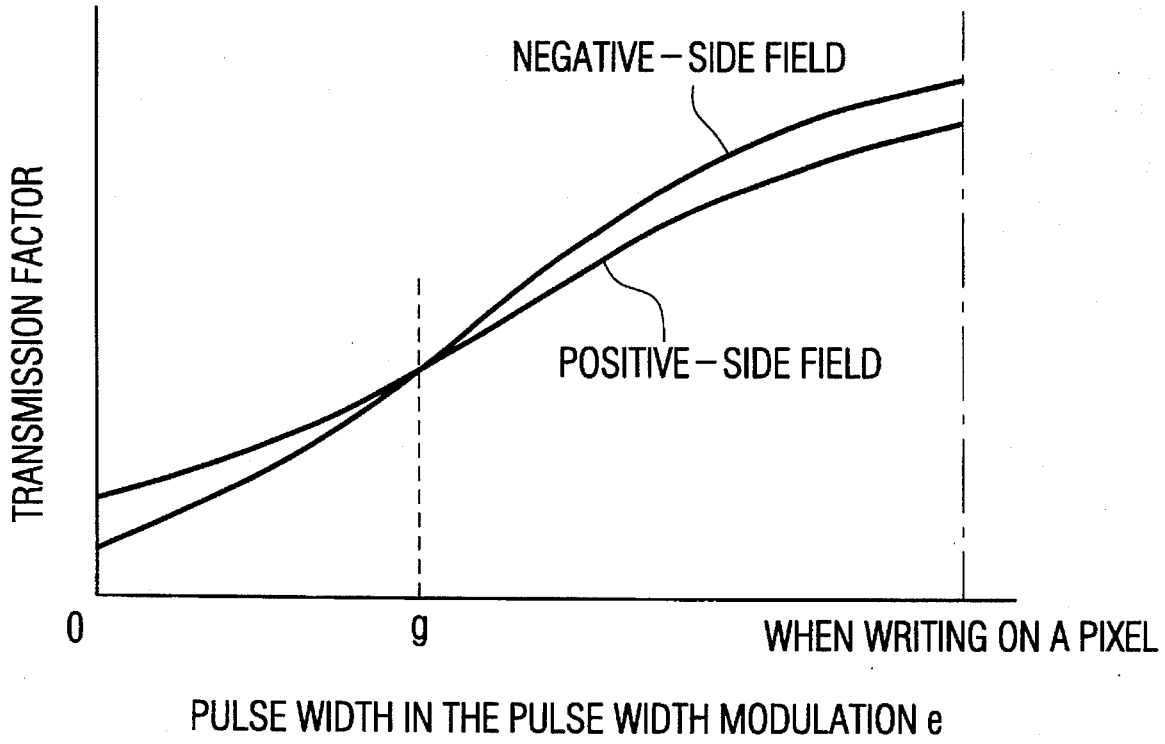
FIG. 14 PRIOR ART
FIG. 14 is a diagram illustrating a relationship between the pulse width and the transmission factor according to a conventional pulse width modulation driving method.

For another modification as shown FIG. 8, transmission range T1 to T2 desired to modulate is determined in FIG. 2. The pulse amplitudes of data signals are set to be equal to each other in the positive-side field and the negative-side, while the difference at both ends of the pulse width occurs in the prior art as shown in FIG. 14. Even if a1, b1, b0 in FIG. 8 are set to make the difference as small as possible, when the pulse widths are set to be equal to each other in the positive-side field and the negative-side field to drive the liquid crystal display panel, the difference of the transmission factor exists for each of gradations as shown in FIG. 14. Therefore the pulse width is corrected to $e \geqq e'$, if $e \geqq g$ (FIG. 14) and $e<e'$, if $e<g$ so that the difference of the transmission factor becomes as small as possible. Also, in the FIG. 3, the applied voltages from the signal electrode are four levels, that is, there are a2/2, −a2/2 in the positive-field and b2/2, −b2/2 in the negative-field. The invention deals with a method for making the above method more simpler, that is, enabling the applied voltages from the signal electrode to be three levels. FIG. 9 shows an example of thereof. The applied voltage from the scanning electrode during the writing is set to be a1 in the positive-side field and b1−(a2−b2)/2=b3 in the negative-side field. In this case, the offset voltage during the writing Voff1 is set to be a1−b3. This offset voltage can be optimized for the pulse width modulation in this way and creates a special case of offset voltage from the standpoint of prior art. Also, the applied voltage from the signal electrode is formed to be three levels so as to be a2/2, −a2/2 in the positive field and b4=a2/2, −b2/2+(a2−b2)/2.

The driving method of this embodiment makes it possible to apply the same voltage to the liquid crystal layer in the positive-side field and in the negative-side field. As a result, no DC component is applied, and the display is realized without flickering and scorching of the image.

According to the method of driving the liquid crystal display panel of the present invention, the signal levels of the data signals are changed depending upon the characteristics of the non-linear resistance element, and the liquid crystal pixels are impressed with a write voltage that corresponds more correctly to the positive-side and negative-side transmission factor modulating ranges, making it possible to obtain a display with little flickering and scorching. Moreover, even when the gradation display is effected based on the pulse width modulation, the pulse width is adjusted depending upon the non-linear characteristics. Therefore, an equal voltage is applied to the liquid crystal layer on the positive side and on the negative side, making it possible to realize the gradation display with less flickering and scorching.

Further, the data signals may be formed in the three levels to provide a reasonable circuit construction of a voltage supplying source and to drive the liquid crystal display panel with high accuracy.

I claim:

1. A liquid crystal display device capable of gradational display, including a plurality of scanning electrodes and a plurality of signal electrodes, display elements arranged in a matrix and corresponding to intersecting points of both the scanning electrodes and the signal electrodes, means for applying scanning signals to the scanning electrodes, and means for applying data signals that have information concerning a plurality of gradations, to the signal electrodes, a bias voltage being applied to the scanning signal during a non-writing period of the scanning signal, each of the display elements having both a liquid crystal pixel and a non-linear resistance element that exhibits asymmetric non-linear characteristics, depending on the polarity of the applied voltage, so as to exhibit asymmetric electric-optical characteristics; and wherein a difference voltage between the scanning signal and the data signal is applied to each of the display elements in a positive-side field, and the difference voltage being a negative voltage is applied thereto in a negative-side field, said data signal being in the form of a bipolar pulse having a pair of positive and negative pulses for the respective gradations, and both a ratio of a width of the positive pulse in the positive-side field to a width of the negative pulse therein and a ratio of a width of the negative pulse in the negative-side field to a width of the positive pulse therein are set independently of each other, depending on the asymmetric electric-optical characteristics of the display elements.

2. The liquid crystal display device of claim 1, wherein two kinds of said data signals in the positive-side fields are different in voltage amplitude from said data signals in the negative-side fields.

3. The liquid crystal display device of claim 1, wherein two kinds of said data signals in the positive-side field are the same in voltage amplitude and said data signals in the negative side fields.

4. A liquid crystal display device, including a plurality of scanning electrodes and a plurality of signal electrodes, display elements arranged in a matrix and corresponding to intersecting points of both the scanning electrodes and the signal electrodes, means for applying scanning signals to the scanning electrodes, and means for applying data signals to the signal electrodes, a bias voltage being applied to the scanning signal during a non-writing period of the scanning signal;

each of the display elements having both a liquid crystal pixel and a non-linear resistance element that exhibits asymmetric non-linear characteristics, depending on the polarity of the applied voltage, so as to exhibit asymmetric electric-optical characteristics; and wherein a positive voltage is applied to each of the display elements in a positive-side field, and a negative voltage is applied thereto in a negative-side field;

said data signals which are pulse signals become common in a higher voltage side or a lower voltage side to the positive-side field and the negative-side field and amplitudes of the pulse signals are independently set in the positive side field and the negative-side field depending on the asymmetric electric-optical characteristics of the display elements.

5. The liquid crystal display device of claim 4, wherein:

said data signals have information concerning a plurality of gradations and are in the form of a bipolar pulse having a pair of positive and negative pulses for the respective gradations, and both a ratio of a width of the positive pulse in the positive-side field to a width of the negative pulse therein and a ratio of a width of the negative pulse in the negative-side field to a width of the positive pulse therein are set independently, depending on the asymmetric electric-optical characteristics of the display elements.

6. A liquid crystal display device, including a plurality of scanning electrodes and a plurality of signal electrodes, display elements arranged in a matrix and corresponding to intersecting points of both the scanning electrodes and the signal electrodes, means for applying scanning signals to the scanning electrodes, and means for applying data signals to the signal electrodes, a bias voltage being applied to the scanning signal during a non-writing period of the scanning signal; wherein each of the display elements has both a liquid crystal pixel and a non-linear resistance element that exhibits asymmetric non-linear characteristics, depending on the polarity of the applied voltage, so as to exhibit asymmetric electric-optical characteristics; and wherein a positive voltage is applied to each of the display elements in a positive-side field, and a negative voltage is applied thereto in a negative-side field;

a working transmission factor of said liquid crystal display device being in a range from T1 to T2 for modulation, the voltage amplitude of said data signals being set to a value of an enabling modulation in the working transmission factor from T1 to T2 depending on the asymmetric electron-optical characteristics of the display elements, the voltage amplitude of two kinds of said data signals being independent of each of the positive-side and the negative-side fields, and the select voltages of said scanning signals in the positive side and the negative-side fields being set so as to be about an average value of voltages corresponding to said transmission factors T1 and T2, depending on the asymmetric electron-optical characteristics of the display elements.

* * * * *

UNITED STATES PATENT AND TRADEMARK OFFICE

CERTIFICATE OF CORRECTION

PATENT NO. : 5,561,441

DATED : October 1, 1996

INVENTOR(S) : Yasukazu Hamano

It is certified that error appears in the above-indentified patent and that said Letters Patent is hereby corrected as shown below:

On the title page, item [73] Assignee: change, "LTD." to --Ltd.--.

Signed and Sealed this

Eleventh Day of March, 1997

*Attest:*

*Attesting Officer*

Bruce Lehman

BRUCE LEHMAN

*Commissioner of Patents and Trademarks*